US008425873B2

(12) United States Patent
Maeda et al.

(10) Patent No.: US 8,425,873 B2
(45) **Date of Patent: *Apr. 23, 2013**

(54) TRANSPARENT ELECTROCONDUCTIVE THIN FILM AND ITS PRODUCTION METHOD

(75) Inventors: Yutaka Maeda, Tokyo (JP); Takeshi Akasaka, Ibaraki (JP)

(73) Assignee: Japan Science and Technology Agency, Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/452,579

(22) PCT Filed: Jul. 10, 2008

(86) PCT No.: PCT/JP2008/062521

§ 371 (c)(1),
(2), (4) Date: Apr. 16, 2010

(87) PCT Pub. No.: WO2009/008486

PCT Pub. Date: Jan. 15, 2009

(65) Prior Publication Data

US 2010/0221172 A1 Sep. 2, 2010

(30) Foreign Application Priority Data

Jul. 10, 2007 (JP) ..... 2007-181411

(51) Int. Cl.
*D01F 9/12* (2006.01)
*B05D 5/12* (2006.01)

(52) U.S. Cl.
USPC ..... 423/447.1; 427/108; 427/110; 427/122; 427/427; 427/58; 977/750; 977/932

(58) Field of Classification Search .... 423/447.1–447.3, 423/445 B; 977/742–754, 842–848; 428/367; 427/58, 108, 110, 122, 427
See application file for complete search history.

(56) References Cited

U.S. PATENT DOCUMENTS 6,749,826 B2 * 6/2004 Tillotson et al. ..... 423/447.2
2004/0043219 A1 * 3/2004 Ito et al. ..... 428/408

(Continued)

FOREIGN PATENT DOCUMENTS

WO 2006/013788 2/2006
WO WO 2006/013788 * 9/2006
WO 2006/132254 12/2006

OTHER PUBLICATIONS

Maeda, et al., Large-Scale Separation of Metallic and Semiconducting Single-Walled Carbon Nanotubes, J. Am. Chem. Soc. 2005; 127: 10287-10290.*

(Continued)

*Primary Examiner* — Daniel C McCracken
(74) *Attorney, Agent, or Firm* — Wenderoth, Lind & Ponack, L.L.P.

(57) ABSTRACT

Provided are a transparent electroconductive thin film of single-walled carbon nanotubes and its production method capable of further enhancing the electroconductivity and the light transmittance of the film and capable of simplifying the thin film formation process. The method comprises: dispersing single-walled carbon nanotubes of mixed metallic single-walled carbon nanotubes (m-SWNTs) and semiconductor single-walled carbon nanotubes (s-SWNTs) in an amine solution containing an amine having a boiling point of from 20 to 400° C. as a dispersant; centrifuging or filtering the resulting dispersion to concentrate m-SWNTs, thereby giving a dispersion rich in m-SWNTs; and applying the resulting dispersion rich in m-SWNTs onto a substrate to form a thin film thereon.

8 Claims, 12 Drawing Sheets

U.S. PATENT DOCUMENTS

| | | | | |
|---|---|---|---|---|
| 2004/0265550 | A1* | 12/2004 | Glatkowski et al. | 428/209 |
| 2008/0308772 | A1* | 12/2008 | Akasaka et al. | 252/502 |

OTHER PUBLICATIONS

Handbook of Chemistry and Physics Wed Edition, Physical Constants of Organic Compounds for 1 Octylamine (accessed online at http://www.hbcpnetbase.com/tables/default.asp on Feb. 28, 2011).*

Geng, et al., Effect of Acid Treatment on Carbon Nanotube-Based Flexible Transparent Conducting Films, J. Am. Chem. Soc. 2007; 129: 7758-7759.*

Wu, et al., Transparent Conductive Carbon Nanotube Films, Science 2004; 305: 1273-1276.*

International Search Report issued Sep. 22, 2008 in International (PCT) Application No. PCT/JP2008/062521.

Wang et al., "Metallic Single-Walled Carbon Nanotubes for Conductive Nanocomposites", J. Am. Chem. Soc., 2008, vol. 130, pp. 1415-1419.

Geng et al., "Effect of Acid Treatment on Carbon Nanotube-Based Flexible Transparent Conducting Films", J. Am. Chem. Soc., 2007, vol. 129, pp. 7758-7759.

Blackburn et al., "Transparent Conductive Single-Walled Carbon Nanotube Networks with Precisely Tunable Ratios of Semiconducting and Metallic Nanotubes", ACS NANO, May 29, 2008, vol. 2, No. 6, pp. 1266-1274.

* cited by examiner 0 5.00 μm

Data type Amplitude
Z range 0.3000 V

TRANSPARENT ELECTROCONDUCTIVE THIN FILM AND ITS PRODUCTION METHOD

TECHNICAL FIELD

The present invention relates to a transparent electroconductive thin film and its production method.

BACKGROUND ART

ITO (indium tin oxide) is a compound produced by adding a few % of tin oxide ($SnO_2$) to indium oxide ($In_2O_3$); and since it is electroconductive and is highly transparent as having a visible light transmittance of about 90% or so, it is used as an electrode mainly for flat panel displays (FPD); and with the recent increase in the shipment of FPD, the demand for ITO transparent electroconductive thin films is expanding.

However, indium that is the main ingredient of ITO is a rare metal and the exhaustion of indium resources is a serious problem; and the sense of crisis about it is increasing and the indium cost is increasing.

Accordingly, methods of collecting ITO wastes for recycling indium have been proposed, and further, trials of increasing the collection rate have been tried; however, as a radical resolution, development of materials substitutive for ITO transparent electroconductive thin films is greatly desired.

As a material substitutive for ITO transparent electroconductive thin films, proposed is a transparent electroconductive thin film of carbon nanotubes (see Patent Reference 1). This Patent Reference 1 discloses a technique of disposing carbon nanotubes on a transparent substrate as dispersed thereon, thereby providing a 550-nm light transmittance of 95% and a surface resistivity of from $10^5$ to $10^{11}\Omega$/sq.

Of carbon nanotubes, however, single-walled carbon nanotubes (SWNTs) include metallic ones (m-SWNTs) and semiconductor ones (s-SWNTs) inevitably as mixed therein in their production process; but in conventional thin films of SWNTs, nothing is taken into consideration about the mixed m-SWNTs and s-SWNTs. Accordingly, the compatibility between the electroconductivity and the light transmittance of thin films is limited.

In conventional thin film formation techniques with SWNTs, a polymer such as an acidic polymer of an alkylammonium salt, a polyoxyethylene-polyoxypropylene copolymer or the like is used as the dispersant for SWNTs, and therefore the thin films are characterized as SWNTs-containing polymer thin films; and the same situation applies to the case of Patent Reference 1. In such thin films, the polymer dispersant remains, and therefore, some limitations are given to the compatibility between the electroconductivity and the light transmittance of the thin films and to the process of forming the thin films.

The present inventors are promoting studies of dispersing single-walled carbon nanotubes with an amine as a dispersant; and in the past, the inventors have proposed a technique of concentrating SWNTs as combined with centrifugation or the like (see Patent Reference 2), but have heretofore made no investigations about thin film formation using them and about the physical properties such as light transmittance, electroconductivity and the like of the thin films, and any concrete facts have not been clarified at all.

Patent Reference 1: JP-A-2006-049843

Patent Reference 2: WO2006/013788

DISCLOSURE OF THE INVENTION

Problems that the Invention is to Solve

The present invention has been made in consideration of the above-mentioned situation, and its subject matter is to provide a transparent electroconductive thin film of single-walled carbon nanotubes and its production method capable of further enhancing the electroconductivity and the light transmittance of the film and capable of simplifying the thin film formation process.

Means for Solving the Problems

To solve the above-mentioned problems, the invention includes the following characteristics:

First:

A method for producing a transparent electroconductive thin film including: dispersing single-walled carbon nanotubes of mixed metallic single-walled carbon nanotubes (m-SWNTs) and semiconductor single-walled carbon nanotubes (s-SWNTs) in an amine solution containing an amine having a boiling point of from 20 to 400° C. as a dispersant, centrifuging or filtering the resulting dispersion to concentrate m-SWNTs, thereby giving a dispersion rich in m-SWNTs, and applying the resulting dispersion rich in m-SWNTs onto a substrate to form a thin film thereon.

Second:

The method for producing a transparent electroconductive thin film of the above first, wherein the amine is at least one selected from primary amines, secondary amines, tertiary amines and aromatic amines.

Third:

The method for producing a transparent electroconductive thin film of the above first or second, wherein the amine is at least one selected from isopropylamine, diethylamine, propylamine, 1-methylpropylamine, triethylamine and N,N,N',N'-tetramethylenediamine.

Fourth:

The method for producing a transparent electroconductive thin film of any of the above first to third, wherein the single-walled carbon nanotubes are dispersed in the amine solution while ultrasonically processed.

Fifth:

The method for producing a transparent electroconductive thin film of any of the above first to fourth, wherein the dispersion rich in m-SWNTs is sprayed onto the substrate with an air brush to form a thin film thereon.

Sixth:

The method for producing a transparent electroconductive thin film of any of the above first to fifth, which includes a step of processing the thin film with hydrochloric acid after the dispersion rich in m-SWNTs is applied onto a substrate.

Seventh:

The method for producing a transparent electroconductive thin film of any of the above first to sixth, wherein the dispersion is centrifuged under the condition of from 40,000 to 100,000 G and for 1 to 168 hours.

Eighth:

A transparent electroconductive thin film substantially including single-walled carbon nanotubes containing metallic single-walled carbon nanotubes (m-SWNTs) and having a visible light transmittance of from 96 to 97% in a wavelength range of from 400 to 800 nm and a surface resistivity of less than $5\times10^4\Omega$/sq.

Ninth:

A transparent electroconductive thin film substantially including single-walled carbon nanotubes containing metallic single-walled carbon nanotubes (m-SWNTs) and having a visible light transmittance of from 85 to 96% in a wavelength range of from 400 to 800 nm and a surface resistivity of less than $1\times10^4\Omega$/sq.

Advantage of the Invention

In the production method of the invention, an amine is used as the dispersant, and therefore bundles of single-walled carbon nanotubes can be unbundled and dispersed; and therefore, the resulting dispersion may be applied onto a substrate for film formation to form thereon a thin film of high electroconductivity, and in addition, since m-SWNTs are concentrated through centrifugation or filtration to give the dispersion rich in m-SWNTs, the electroconductivity of the thin film can be greatly increased even though the amount of the single-walled carbon nanotubes to be used is reduced, and a thin film satisfying both high electroconductivity and good light transmittance can be produced. Concretely, for example, the surface resistivity of the thin film can be increased 50 times as compared with that in a case where m-SWNTs are not concentrated.

In addition, use of an organic polymer as a dispersant or a binder is not indispensable, but an amine having a low boiling point is used as the dispersant; and therefore the operation of dispersing single-walled carbon nanotubes, concentrating m-SWNTs and film formation can be attained in a series of one-process steps in a simplified manner. Since an amine having a low boiling point is used as the dispersant, the amine can be readily removed from the formed thin film through heating, washing or the like after the dispersion is applied onto the substrate; and therefore the dispersant to be an impurity that may bring about reduction in the electroconductivity of the formed film may be readily removed, and a thin film of high electroconductivity can be produced in a simplified manner. Further, since the dispersion and the concentration of single-walled carbon nanotubes with an amine are not accompanied by chemical reaction, the electroconductivity of m-SWNTs is not lowered.

Since an amine having a low boiling point is used, the degree of concentration of m-SWNTs in the dispersion can be readily controlled by varying the type and the concentration of the amine, the condition in centrifugation, etc.; and as a result, the electroconductivity of the formed thin film can be readily controlled within a broad range of from low electroconductivity to high electroconductivity.

The transparent electroconductive thin film of the invention is produced by applying onto a substrate single-walled carbon nanotubes prepared by concentrating m-SWNTs by the use of an amine as the dispersant but not substantially containing a polymer such as a polymer dispersant, a binder or the like; and therefore, the electroconductivity of the formed thin film can be greatly increased even though the amount of the single-walled carbon nanotubes to be used is reduced, and the thin film may have high electroconductivity and light transmittance.

Figure 1:
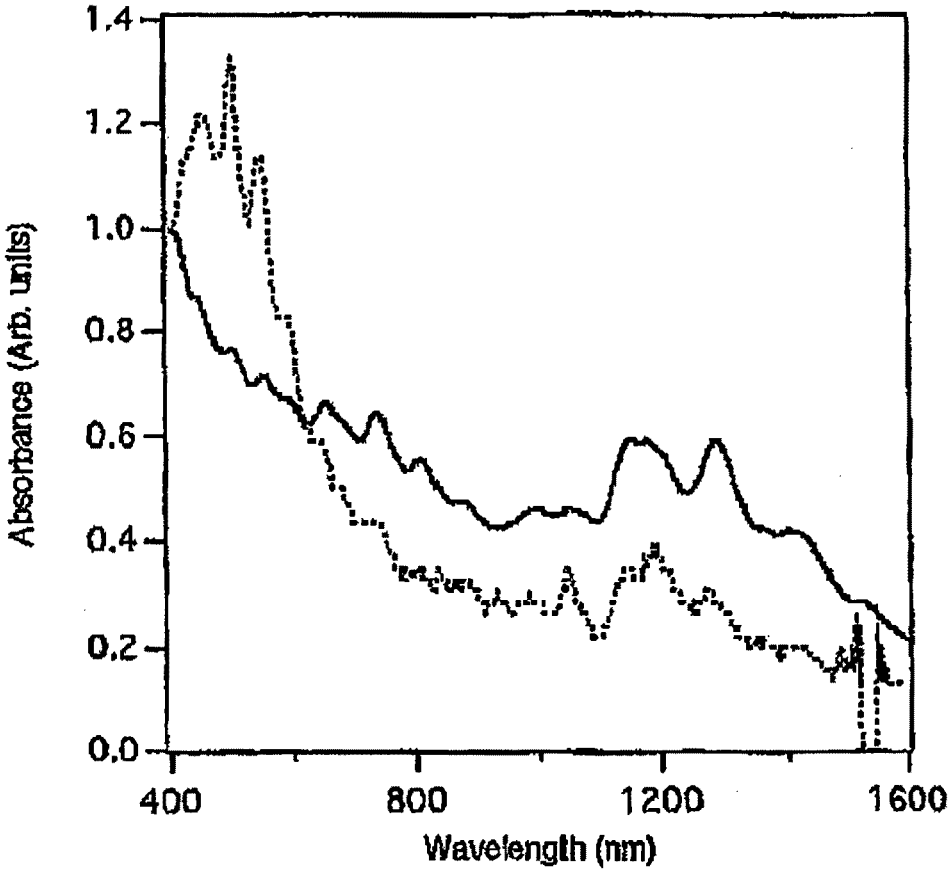
FIG. 1 It shows absorption spectra of single-walled carbon nanotubes of dispersion 1 (dotted line) and single-walled carbon nanotubes of dispersion 2 (solid line) in Example 1.

The invention is described in detail hereinunder.

In the invention, usable are various single-walled carbon nanotubes including commercially-available ones and those produced in various production methods. Single-walled carbon nanotubes generally used in the art have a diameter of, for example, from 0.8 to 2.0 nm or so. Preferably, some types of single-walled carbon nanotubes are previously purified before use herein. For example, depending on the production method for single-walled carbon nanotubes, impurities such as amorphous carbon, metal catalyst and others may be present in the single-walled carbon nanotubes; but through pretreatment in an oxidation purification method of essentially heating the product in air, the degree of concentration of m-SWNTs may be readily controlled to give a dispersion of high-purity m-SWNTs; and using this, a transparent electroconductive thin film of SWNTs having a controlled content of m-SWNTs can be produced.

The morphology of the single-walled carbon nanotubes is not specifically defined, but from the viewpoint of increasing the electroconductivity of the formed thin film, the single-walled carbon nanotubes are preferably longer ones. Specifically, even though the electroconductivity of one single-walled carbon nanotube could be high, the electroconductivity of a thin film of plural single-walled carbon nanotube could not be in fact on the theoretically estimated level since the resistance in electron transfer between the single-walled carbon nanotubes is high. However, one longer single-walled carbon nanotube could cover a broader range, and the possibility of overlapping of such longer single-walled carbon nanotubes with each other could be higher; and as a result, each single-walled carbon nanotube could individually contribute toward the increase in the electroconductivity of the thin film, and the electroconductivity of the thin film is thereby increased.

Single-walled carbon nanotubes produced in ordinary production methods are said to have a content of metallic single-walled carbon nanotubes (m-SWNTs) of about 30%; but in the invention, the proportion of m-SWNTs in the film may be any desired one.

In the invention, based on the electronic interaction between single-walled carbon nanotubes and amine and on the difference in the interaction between metallic single-walled carbon nanotubes (m-SWNTs) and semiconductor single-walled carbon nanotubes (s-SWNTs) with amine, bundled single-walled carbon nanotubes are separated and m-SWNTs are concentrated.

Regarding the interaction between m-SWNTs and s-SWNTs with amine, typically it is considered that though depending on the type of the amine, the interaction between m-SWNTs and amine may be stronger than that between s-SWNTs and amine owing to the strong electron acceptability of m-SWNTs. More precisely, m-SWNTs have strong electron acceptability to the electron of the nitrogen atom of amine, and therefore the two, m-SWNTs and amine may undergo strong interaction therebetween. Owing to such strong interaction, bundled m-SWNTs are dispersed into unbundled individually-isolated m-SWNTs. On the other hand, s-SWNTs that are caked as an undispersed state and have a large specific gravity settle down to give a precipitate, and therefore the supernatant liquid with m-SWNTs dispersed therein can be separated and m-SWNTs can be thereby concentrated.

The amine as the dispersant may be an amine having a boiling point of from 20 to 400° C., preferably from 20 to 300° C., for example, including primary to tertiary amines such as aliphatic amines, cyclic amines, acid amides and the like, or aromatic amines, etc. One or more of these may be used either singly or as combined.

Specific examples of the aliphatic amines include monoamines such as n-propylamine, isopropylamine, 1-methylpropylamine, n-octylamine, diethylamine, dipropylamine, dioctylamine, triethylamine, tripropylamine, trioctylamine and N,N-dimethyl-n-octylamine; diamines such as ethylenediamine, N,N,N',N'-tetramethylenediamine, N,N-dimethylethylenedianxine and N,N,N',N'-tetramethylethylenediamine; triamines such as diethylenetriamine, N-(3-aminopropyl)-1,3-propanediamine and pentaethylenehexamine.

Specific examples of the cyclic amines include cyclohexylamine, 1,2-diaminocyclohexane, 1,8-diazabicyclo[5,4,0]-1-undecene, etc.

Specific examples of the aromatic amines include piperidine, 1-methylpiperidine, etc.

Specific examples of the acid amides include N,N-dimethylformamide, etc.

Above all, preferred is use of at least one selected from isopropylamine, diethylamine, propylamine, 1-methylpropylamine, triethylamine, and N,N,N',N'-tetramethylenediamine, from the viewpoint of the capability of efficient concentration of m-SWNTs therewith.

In the invention, the solvent for the amine solution is not specifically defined and may be any one solvophilic with amine; and its specific examples include tetrahydrofuran (THF), alcohol, glycol, dimethylsulfoxide (DMSO), etc. One or more of these may be used either singly or as combined.

Additives such as surfactant, defoaming agent and the like may be added to the amine solution. However, an organic polymer, for example, a polymer dispersant or a binder such as a thermoplastic resin or the like may worsen the physical properties of the formed thin film and may complicate the process of thin film formation; and therefore, use of an organic polymer is preferably evaded from the viewpoint of the physical properties of the thin film to be formed and of the simplification of the process of thin film formation.

Ultrasonic treatment is preferred in dispersing single-walled carbon nanotubes in the amine solution. Ultrasonic treatment may be attained, for example, through irradiation with ultrasonic waves for 1 minute to 168 hours.

The amine concentration in the amine solution is not specifically defined, but may fall, for example, within a range of from 1 to 5 M.

Through centrifugation or filtration of the dispersion of single-walled carbon nanotubes, m-SWNTs may be concentrated to give a dispersion rich in m-SWNTs. Centrifugation may be attained preferably with a power of from 100 to 100,000 G, more preferably from 40,000 to 100,000 G, and preferably for 1 minute to 168 hours, more preferably for 1 to 168 hours; and the content of m-SWNTs in the resulting dispersion may be controlled by controlling the power and the time for centrifugation. By increasing the power for centrifugation or prolonging the time for it, the content of m-SWNTs may be thereby increased.

By varying the specific gravity of the solvent, the relative specific gravity of the undispersed s-SWNTs to the dispersion may be thereby changed; and therefore, the content of m-SWNTs may be controlled depending on the specific gravity of the solvent.

In applying the thus-produced m-SWNTs-rich dispersion onto a substrate for film formation thereon, employable are a method of spray-coating with an air brush or the like, an LB (Langmuir Blodgett) method, a dip coating method, a spin coating method, a drying method, a filtration method, etc. Above all, the method of using an air brush enables direct formation of a thin film from the m-SWNTs-rich dispersion and enables easy control of the transmittance of the formed thin film.

Examples of the substrate include solid substrates, films or sheets of transparent resin (for example, having a visible light transmittance of at least 80%), glass sheets, etc.

After the m-SWNTs-rich dispersion is applied onto a substrate, the amine may be removed through heating, pressure reduction, washing with solvent or the like. The solvent includes, for example, ethanol, ether, aliphatic hydrocarbon solvents, etc.

After the m-SWNTs-rich dispersion is applied onto a substrate, the thin film formed may be processed with hydrochloric acid whereby the electroconductivity of the thin film may be further increased. In particular, when the thin film having a high content of s-SWNTs is processed with hydrochloric acid, then the electroconductivity of the resulting thin film can be greatly increased; and this may be considered because the treatment with hydrochloric acid may cause doping to s-SWNTs in the thin film.

In the manner as above, a transparent electroconductive thin film excellent in both electroconductivity and light transmittance is obtained. The thin film can be observed as a network of dense and uniform single-walled carbon nanotubes with no outstanding impurities, using an electron microscope or the like. Not specifically defined, the film thickness may be, for example, from 10 to 100 nm.

The electro conductivity of the thin film of single-walled carbon nanotubes to be produced according to the invention may be controlled in a broad range by suitably controlling the condition; and for example, according to the invention, the following thin films can be produced.

i) A transparent electroconductive thin film substantially including single-walled carbon nanotubes containing metallic single-walled carbon nanotubes (m-SWNTs) and having a visible light transmittance of from 96 to 97% in a wavelength range of from 400 to 800 nm and a surface resistivity of less than $5\times10^4\Omega$/sq, preferably less than $1\times10^4\Omega$/sq.

ii) A transparent electroconductive thin film substantially including single-walled carbon nanotubes containing metallic single-walled carbon nanotubes (m-SWNTs) and having a visible light transmittance of from 85 to 96% in a wavelength range of from 400 to 800 nm and a surface resistivity of less than $1\times10^4\Omega$/sq.

"Substantially" as referred to herein means that the film does not contain a large quantity of a nonvolatile polymer ingredient, for example, a polymer dispersant, a binder such as a thermoplastic resin or the like.

For example, in the single-walled carbon nanotubes SWNTs having a broad diameter distribution as in Examples (as one example, those having a diameter distribution of from 0.9 to 1.3 nm), the apparent degree of concentration of m-SWNTs may be calculated from the peak area ratio of the Raman spectrum thereof. In this case, it may be considered that the treatment for concentration of m-SWNTs may give a dispersion in which the proportion of m-SWNTs in RUM in the Raman spectrum ($(\text{m-SWNTs}_{RBM}/(\text{m-SWNTs}_{RBM}+\text{s-SWNTs}_{RBM})\times100)$ is at least 94% in measurement at an excitation wavelength of 514.5 nm and is at least 80% in measurement at an excitation wavelength of 633 nm.

EXAMPLES

The invention is described in more detail with reference to the following Examples; however, the invention is not limited at all by these Examples.

Example 1

4 mg of single-walled carbon nanotubes of m-SWNTs and s-SWNTs mixed as bundles (HiPco Tube, by Carbon Nanotechnologies, Inc.) were added to a 5 M propylamine solution (solvent: tetrahydrofuran) and then ultrasonically processed at 5 to 10° C. for 2 hours to thereby uniformly disperse the single-walled carbon nanotubes. Next, this was centrifuged at 45,620 G for 12 hours to prepare a dispersion (hereinafter referred to as "dispersion 1").

On the other hand, 4 mg of the single-walled carbon nanotubes as above were added to a 1 M propylamine solution (solvent: tetrahydrofuran) and then ultrasonically processed at 5 to 10° C. for 2 hours to thereby uniformly disperse the single-walled carbon nanotubes. Next, this was centrifuged at 14,000 G for 1 hour to prepare a dispersion (hereinafter referred to as "dispersion 2").

The single-walled carbon nanotubes in these dispersions 1 and 2 were analyzed through spectrometry. FIG. 1 shows absorption spectra in a wavelength range of from 400 to 1600 nm. For the spectrometry, used was a spectrophotometer (UV-3150, by Shimadzu Corporation). The single-walled carbon nanotubes in the dispersion 1 (dotted line) gave sharp peaks in a range of from 400 to 650 nm, which indicate that the bundled m-SWNTs were unbundled into individual ones owing to the addition of propylamine to the THF solution. As compared with the pattern of the single-walled carbon nanotubes in the dispersion 2 (solid line), the absorption in the first band transition range (400 to 650 nm) of m-SWNTs in the dispersion 1 increased while the absorption in the second band transition range (550 to 900 nm) of s-SWNTs decreased; and it is known that m-SWNTs were concentrated in the dispersion 1.

Figure 2:
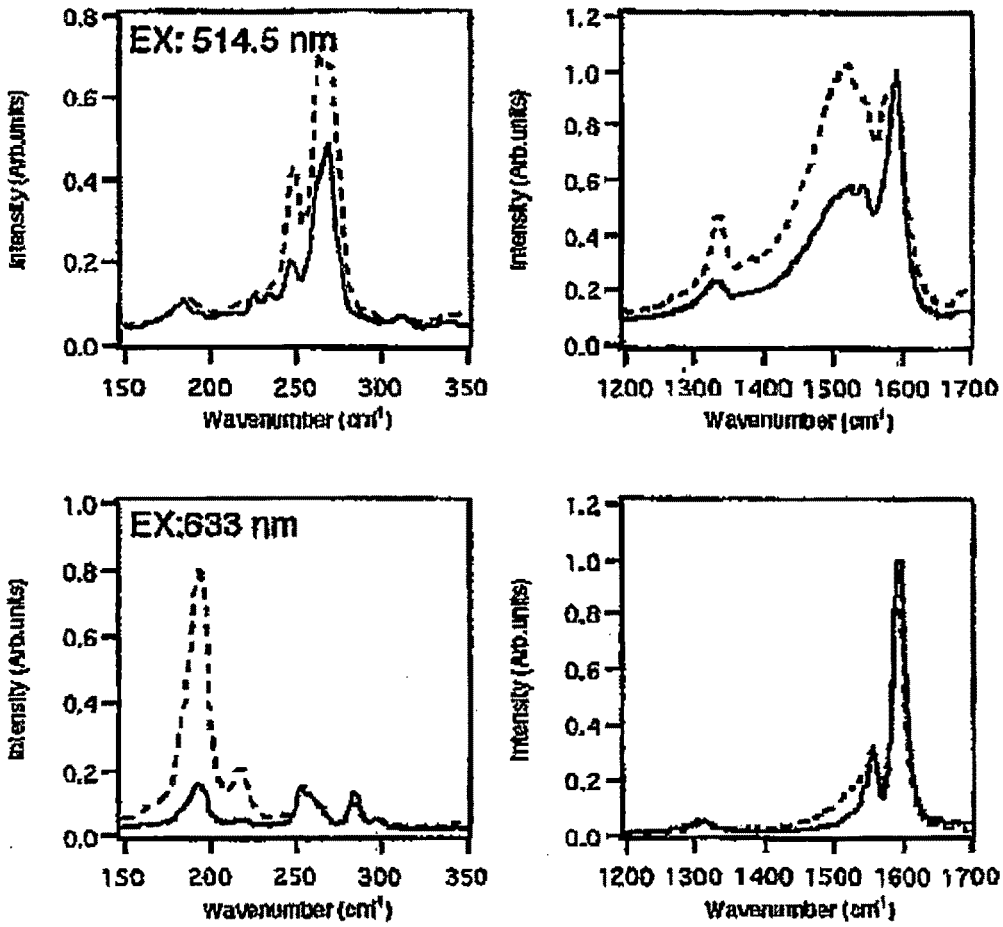
FIG. 2 It shows Raman spectra at an excitation wavelength of 514.5 nm or 633 nm of single-walled carbon nanotubes of dispersion 1 (dotted line) and single-walled carbon nanotubes of dispersion 2 (solid Line) in Example 1.

FIG. 2 shows Raman spectra in 514.5 nm excitation and 633 nm excitation. For Raman spectrometry, used was a Raman spectrometer (HR-800, by HORIBA, Ltd.). The single-walled carbon nanotubes in the dispersion 1 (dotted line) give m-SWNTs-derived radical breathing mode (RBM) peaks at around 260 $cm^{-1}$ and 200 $cm^{-1}$. On the other hand, the single-walled carbon nanotubes in the dispersion 2 (solid line) give s-SWNTs-derived RBM peaks at around 180 $cm^{-1}$ and 260 $cm^{-1}$.

The tangential G band at around 1600 $cm^{-1}$ is a characteristic band for easy discrimination between m-SWNTS and s-SWNTs; and the single-walled carbon nanotubes in the dispersion 1 gave a strong Breit-Wigner-Fango line shape at the tangential G band, which indicates concentration of m-SWNTs.

Before and after centrifugation, the single-walled carbon nanotubes in the dispersion 2 were analyzed through absorption spectrometry, which, however, gave no difference in the characteristic absorption intensity ratio between m-SWNTs and s-SWNTs. The result in the Raman spectrometry also gave no difference in the characteristic absorption intensity ratio between m-SWNTs and s-SWNTs. From these, therefore, it is known that the dispersion 2 has no difference in the m-SWNTs content thereof before and after centrifugation.

The proportion of m-SWNTs in RBM in the Raman spectrum ($(\text{m-SWNTs}_{RBM}/(\text{m-SWNTs}_{RBM}+\text{s-SWNTs}_{RBM})\times100)$ was 94% (excitation wavelength 514.5 nm) and 87% (excitation wavelength 633 nm) in the dispersion 1, and was 91% (excitation wavelength 514.5 nm) and 43% (excitation wavelength 633 nm) in the dispersion 2.

Next, using an air brush, the dispersion 1 was uniformly applied onto the surface of a commercially-available PET sheet having a thickness of 100 μm (transmittance: 86.5%) put on a hot plate at about 85° C., and the solvent tetrahydrofuran and the dispersant propylamine were removed through evaporation by the heat of the hot plate. Next, the thin film was washed with methanol to remove the amine residue, thereby giving a single-walled carbon nanotube thin film-coated PET sheet.

The single-walled carbon nanotube thin film was observed with a scanning electronic microscope and an atomic force microscope, which confirmed the absence of aggregates of single-walled carbon nanotubes but the presence of a large number of single-walled carbon nanotubes individually separated and uniformly dispersed in the film as kept in contact with each other while randomly crosslinked therein.

The surface resistivity of the single-walled carbon nanotube thin film was measured with a four-probe resistivity meter (Loresta by Mitsubishi Chemical) in air at room temperature, and the surface resistivity thereof was $9.0\times10^3\Omega$/sq.

The visible light transmittance in a wavelength range of from 400 to 800 nm of the single-walled carbon nanotube thin film-coated PET sheet and that of the original PET sheet were measured with a spectrophotometer (UV-3150 by Shimadzu Corporation); and the transmittance of the single-walled carbon nanotube thin film was calculated from the difference between the two, and the transmittance thereof was 97.1%.

On the other hand, the dispersion 2 was processed for film formation on the surface of a PET sheet in the same manner as above, thereby forming a single-walled carbon nanotube thin film. The single-walled carbon nanotube thin film was observed with a scanning electronic microscope and an atomic force microscope, which confirmed the absence of aggregates of single-walled carbon nanotubes but the presence of a large number of single-walled carbon nanotubes individually separated and uniformly dispersed in the film as kept in contact with each other while randomly crosslinked therein.

The surface resistivity of the single-walled carbon nanotube thin film was measured with a four-probe resistivity meter (Loresta by Mitsubishi Chemical) in air at room temperature, and the surface resistivity thereof was $2.15\times10^5\Omega$/sq.

The visible light transmittance in a wavelength range of from 400 to 800 nm of the single-walled carbon nanotube thin film-coated PET sheet and that of the original PET sheet were measured with a spectrophotometer (UV-3150 by Shimadzu Corporation); and the transmittance of the single-walled carbon nanotube thin film was calculated from the difference between the two, and the transmittance thereof was 96.6%.

Example 2

Using an air brush, the dispersion 1 produced in Example 1 was uniformly applied onto the surface of a commercially-available quartz glass sheet having a thickness of 2 mm (transmittance: 93.3%) put on a hot plate at about 85° C., and the solvent tetrahydrofuran and the dispersant propylamine were removed through evaporation by the heat of the hot plate. Next, the thin film was washed with methanol to remove the amine residue, thereby giving a single-walled carbon nanotube thin film-coated quartz glass sheet.

The thickness of the single-walled carbon nanotube thin film was 28 nm, as measured with a surface profile analyzer. The single-walled carbon nanotube thin film was observed with a scanning electronic microscope and an atomic force microscope, which confirmed the absence of aggregates of single-walled carbon nanotubes but the presence of a large number of single-walled carbon nanotubes individually separated and uniformly dispersed in the film as kept in contact with each other while randomly crosslinked therein.

The surface resistivity of the single-walled carbon nanotube thin film was measured with a four-probe resistivity meter (Loresta by Mitsubishi Chemical) in air at room temperature, and the surface resistivity thereof was $8.0\times10^2\Omega$/sq.

The visible light transmittance in a wavelength range of from 400 to 800 nm of the single-walled carbon nanotube thin film-coated quartz glass sheet and that of the original quartz glass sheet were measured with a spectrophotometer (UV-3150 by Shimadzu Corporation); and the transmittance of the single-walled carbon nanotube thin film was calculated from the difference between the two, and the transmittance thereof was 80.7%.

On the other hand, the dispersion 2 was processed for film formation on the surface of a quartz glass sheet in the same manner as above, thereby forming a single-walled carbon nanotube thin film. The thickness of the single-walled carbon nanotube thin film was 30 nm, as measured with a surface profile analyzer. The single-walled carbon nanotube thin film was observed with a scanning electronic microscope and an atomic force microscope, which confirmed the absence of aggregates of single-walled carbon nanotubes but the presence of a large number of single-walled carbon nanotubes individually separated and uniformly dispersed in the film as kept in contact with each other while randomly crosslinked therein.

The surface resistivity of the single-walled carbon nanotube thin film was measured with a four-probe resistivity meter (Loresta by Mitsubishi Chemical) in air at room temperature, and the surface resistivity thereof was $8.6\times10^3\Omega$/sq.

The visible light transmittance in a wavelength range of from 400 to 800 nm of the single-walled carbon nanotube thin film-coated quartz glass sheet and that of the original quartz glass sheet were measured with a spectrophotometer (UV-3150 by Shimadzu Corporation); and the transmittance of the single-walled carbon nanotube thin film was calculated from the difference between the two, and the transmittance thereof was 78.2%.

Example 3

Using the dispersions 1 and 2 in Example 1 and in the same manner as in Example 1, plural single-walled carbon nanotube thin films each having a different thickness were formed on the surface of a PET sheet, for which, however, the spraying amount through the air brush was controlled.

Figure 3:
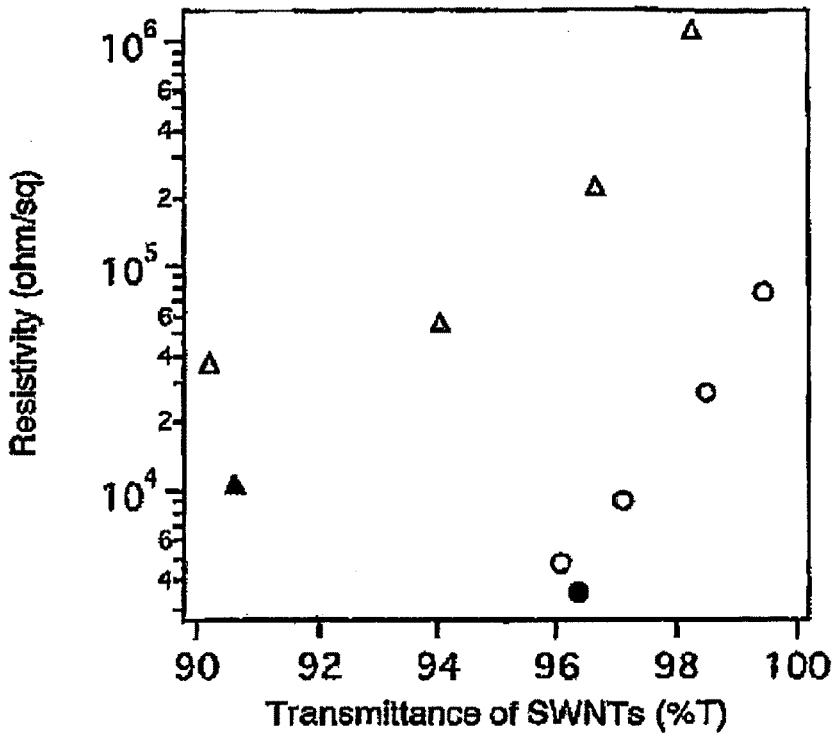
FIG. 3 It is a graph showing the relationship between the light transmittance and the surface resistivity of dispersions 1 and 2 in Example 1.
Figure 4:
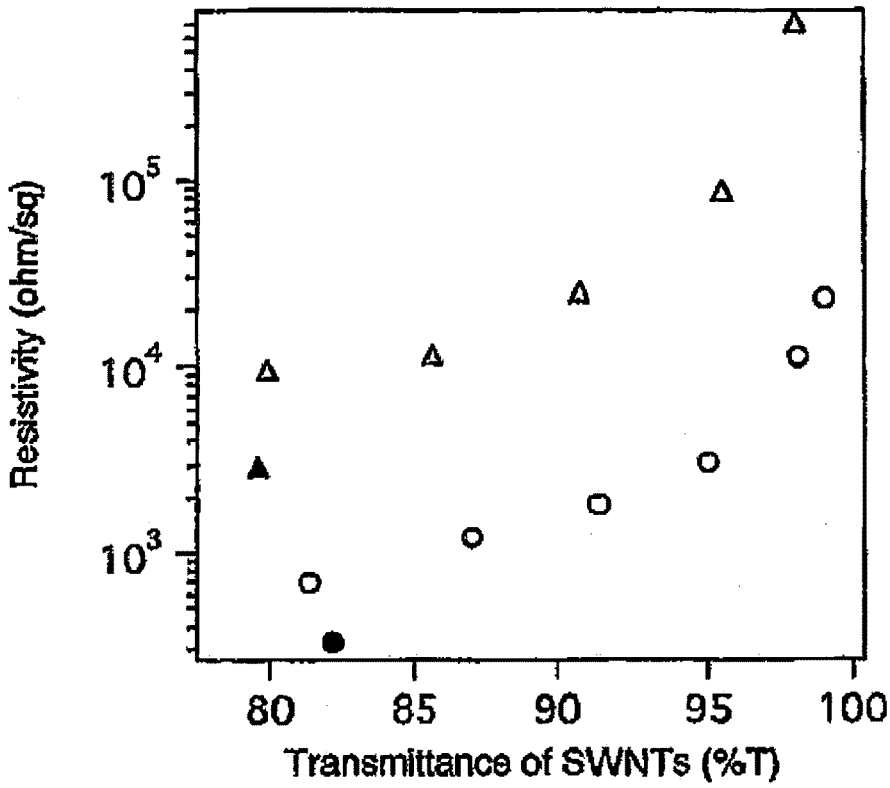
FIG. 4 It is a graph showing the relationship between the light transmittance and the surface resistivity of dispersions 1 and 2 in Example 1.

The relationship between the light transmittance and the surface resistivity of these single-walled carbon nanotube thin films are shown in FIG. 3, FIG. 4 and Table 1.

TABLE 1

| No. | NTs | Condition for Separation | Substrate | Transmittance[a] | Resistivity[b] | Transmittance (after treatment with HCl) | Resistivity (after treatment with HCl) |
|---|---|---|---|---|---|---|---|
| 1 | Dispersion 1 | 5 M Propylamine | PET | 99.4 | 360000 | | |
| 2 | Dispersion 1 | 5 M Propylamine | PET | 98.7 | 24000 | | |
| 3 | Dispersion 1[b] | 5 M Propylamine | PET | 97.1 | 9000 | | |
| 4 | Dispersion 1[b] | 5 M Propylamine | PET | 96.1 | 4800 | 96.4 | 3600 |
| 5 | Dispersion 1 | 5 M Propylamine | PET | 81.4 | 690 | 82.1 | 330 |
| 6 | Dispersion 1 | 5 M Propylamine | Quartz | 80.7 | 800 | | |
| 7 | Dispersion 2 | 1 M Propylamine | PET | 98.8 | 1190000 | | |
| 8 | Dispersion 2[c] | 1 M Propylamine | PET | 98.6 | 215000 | | |
| 9 | Dispersion 2[c] | 1 M Propylamine | PET | 90.2 | 35000 | 90.6 | 10000 |
| 10 | Dispersion 2 | 1 M Propylamine | PET | 80.0 | 8900 | 79.6 | 2800 |
| 11 | Dispersion 2 | 1 M Propylamine | Quartz | 78.2 | 8600 | | |

[a]After washed with MeOH

[b]Proportion of metallic SWNTs in RBM in the Raman spectrum((metallic SWNTsRBM/(metallic SWNTsRBM + semiconductor SWNTsRBM) · 100 (%), 94% (excitation wavelength 514.5 nm), 87% (excitation wavelength 633 nm)

[c]Proportion of metallic SWNTs in RBM in the Raman spectrum ((metallic SWNTsRBM/(metallic SWNTsRBM + semiconductor SWNTsRBM) · 100 (%)), 91% (excitation wavelength 514.5 nm), 43% (excitation wavelength 633 nm)

Concentrating m-SWNTs with an amine serving as a dispersant and using the m-SWNTs-rich dispersion in film formation significantly increased the electroconductivity of the formed thin film even when the amount of the single-walled carbon nanotubes used was reduced; and therefore the formed thin film satisfied both high electroconductivity and light transmittance. Further, by varying the amine concentration and various conditions in centrifugation, etc., the degree of concentration of m-SWNTs in the dispersion could be readily controlled with the result that the electroconductivity of the formed thin films could be readily controlled in a broad range of from low electroconductivity to high electroconductivity.

When the m-SWNTs-rich dispersion was formed into a film and when the film was washed with methanol and thereafter dipped in 12 N hydrochloric acid, then electroconductivity of the formed thin film further increased. In particular, when the thin film formed of the dispersion 2 having a high content of s-SWNTs was processed with hydrochloric acid, then its electroconductivity greatly increased.

Figure 6:
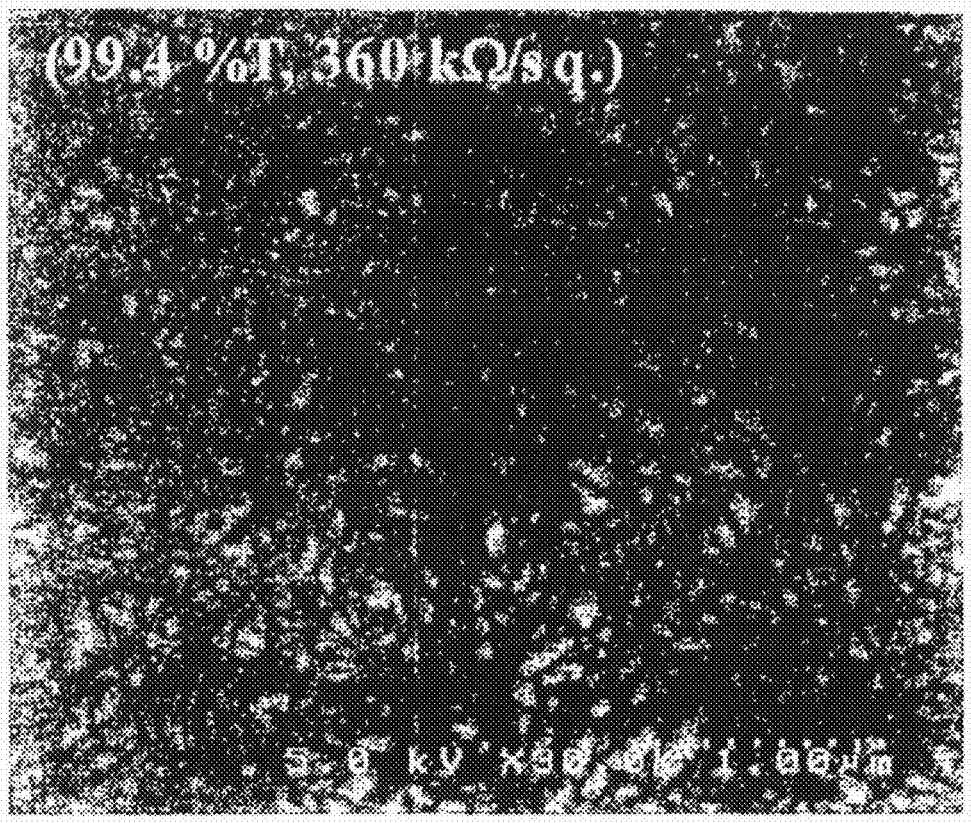
FIG. 6 It is an electron microscopic picture of a single-walled carbon nanotube thin film formed by the use of dispersion 1 with concentrated m-SWNTs therein.
Figure 7:
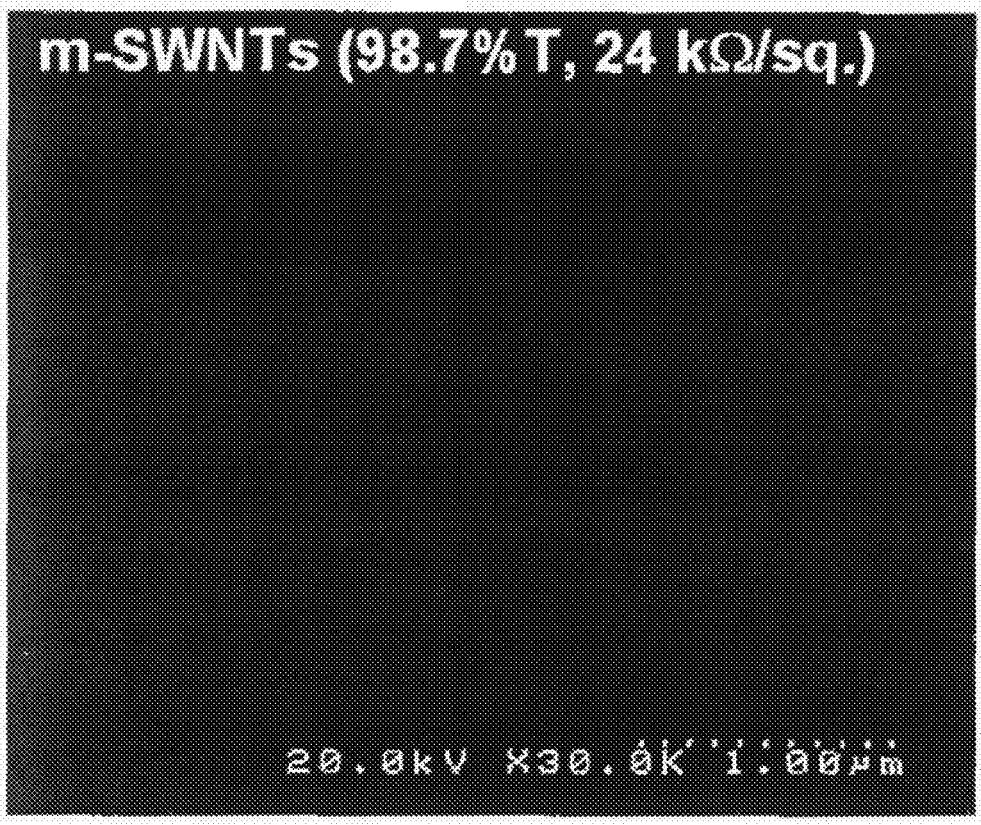
FIG. 7 It is an electron microscopic picture of a single-walled carbon nanotube thin film formed by the use of dispersion 1 with concentrated m-SWNTs therein.
Figure 8:
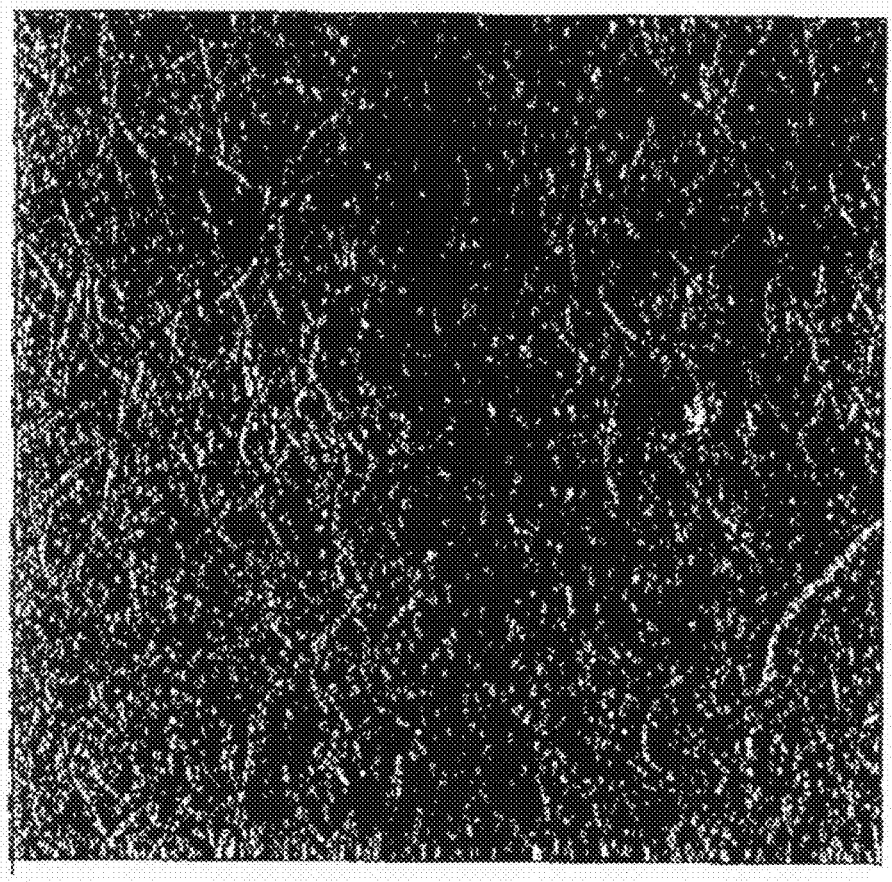
FIG. 8 It is an atomic force microscopic picture of a single-walled carbon nanotube thin film formed by the use of dispersion 1 with concentrated m-SWNTs therein.
Figure 9:
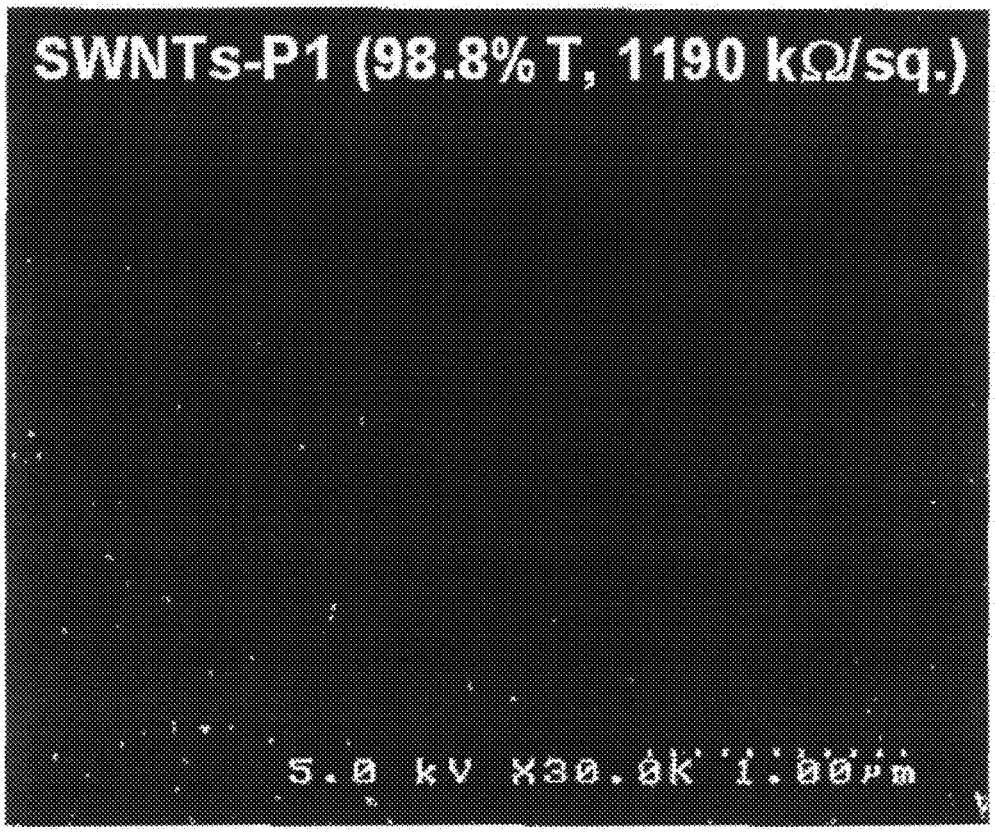
FIG. 9 It is an electron microscopic picture of a single-walled carbon nanotube thin film formed by the use of dispersion 2 with unconcentrated m-SWNTs therein.

An electron microscopic picture of a single-walled carbon nanotube thin film formed by the use of the dispersion 1 with concentrated m-SWNTs therein is in FIG. 6 and FIG. 7 (FIG. 6: transmittance 99.4%, surface resistivity $360\times10^3\Omega$/sq., FIG. 7: transmittance 98.7%, surface resistivity $24\times10^3\Omega$/sq.); and an atomic force microscopic picture thereof is in FIG. 8 (transmittance 99.4%, surface resistivity $360\times10^3\Omega$/sq.). An electron microscopic picture of a single-walled carbon nanotube thin film formed by the use of the dispersion 2 with unconcentrated m-SWNTs therein is in FIG. 9 (transmittance 98.8%, surface resistivity $1190\times10^3\Omega$/sq.).

Example 4

Using the dispersions 1 and 2 in Example 2 and in the same manner as in Example 2, plural single-walled carbon nanotube thin films each having a different thickness were formed on the surface of a quartz glass sheet, for which, however, the spraying amount through the air brush was controlled.

Figure 5:
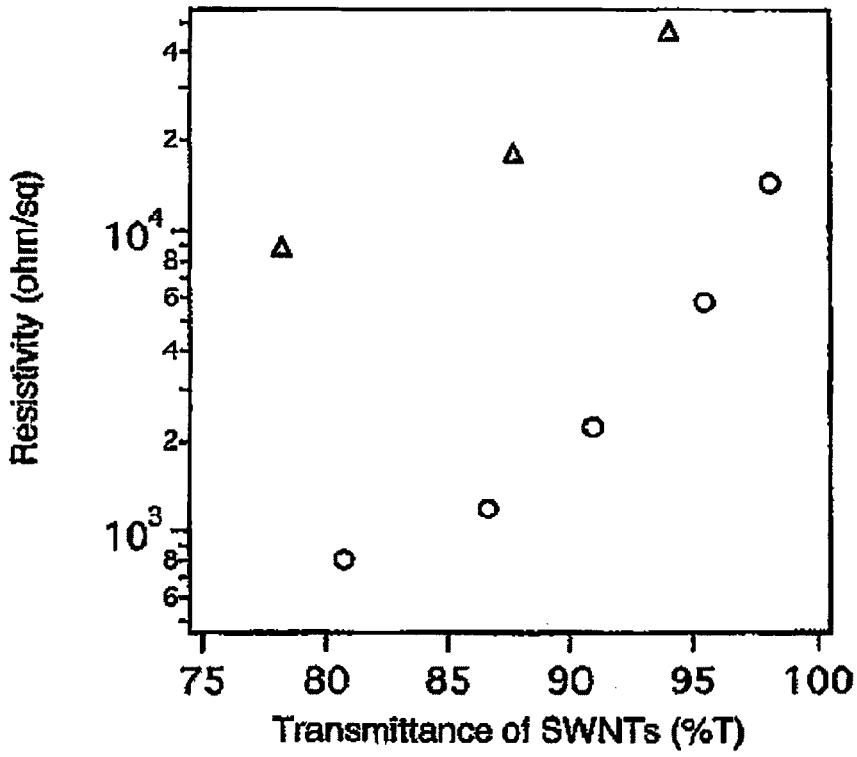
FIG. 5 It is a graph showing the relationship between the light transmittance and the surface resistivity of dispersions 1 and 2 in Example 2.

The relationship between the light transmittance and the surface resistivity of these single-walled carbon nanotube thin films are shown in FIG. 5 and Table 1. Concentrating m-SWNTs with an amine serving as a dispersant and using the m-SWNTs-rich dispersion in film formation significantly increased the electroconductivity of the formed thin film even when the amount of the single-walled carbon nanotubes used was reduced; and therefore the formed thin film satisfied both high electroconductivity and light transmittance. Further, by varying the amine concentration and various conditions in centrifugation, etc., the degree of concentration of m-SWNTs in the dispersion could be readily controlled with the result that the electroconductivity of the formed thin films could be readily controlled in a broad range of from low electroconductivity to high electroconductivity.

Example 5

10 mg of single-walled carbon nanotubes of m-SWNTs and s-SWNTs mixed as bundles (Carbolex AP-Grade, by Carbolex Inc.) that had been heat-treated at 360° C. were added to a 3 M propylamine solution (solvent: tetrahydrofuran) and then ultrasonically processed at 5 to 10° C. for 2 hours to thereby uniformly disperse the single-walled carbon nanotubes. Next, this was centrifuged at 45,620 G for 12 hours to prepare a dispersion (hereinafter referred to as "dispersion 1").

On the other hand, 10 mg of the heat-treated, single-walled carbon nanotubes as above were added to a 1 M propylamine solution (solvent: tetrahydrofuran) and then ultrasonically processed at 5 to 10° C. for 2 hours to thereby uniformly disperse the single-walled carbon nanotubes. Next, this was centrifuged at 14,000 G for 12 hours to prepare a dispersion (hereinafter referred to as "dispersion 2").

Figure 10:
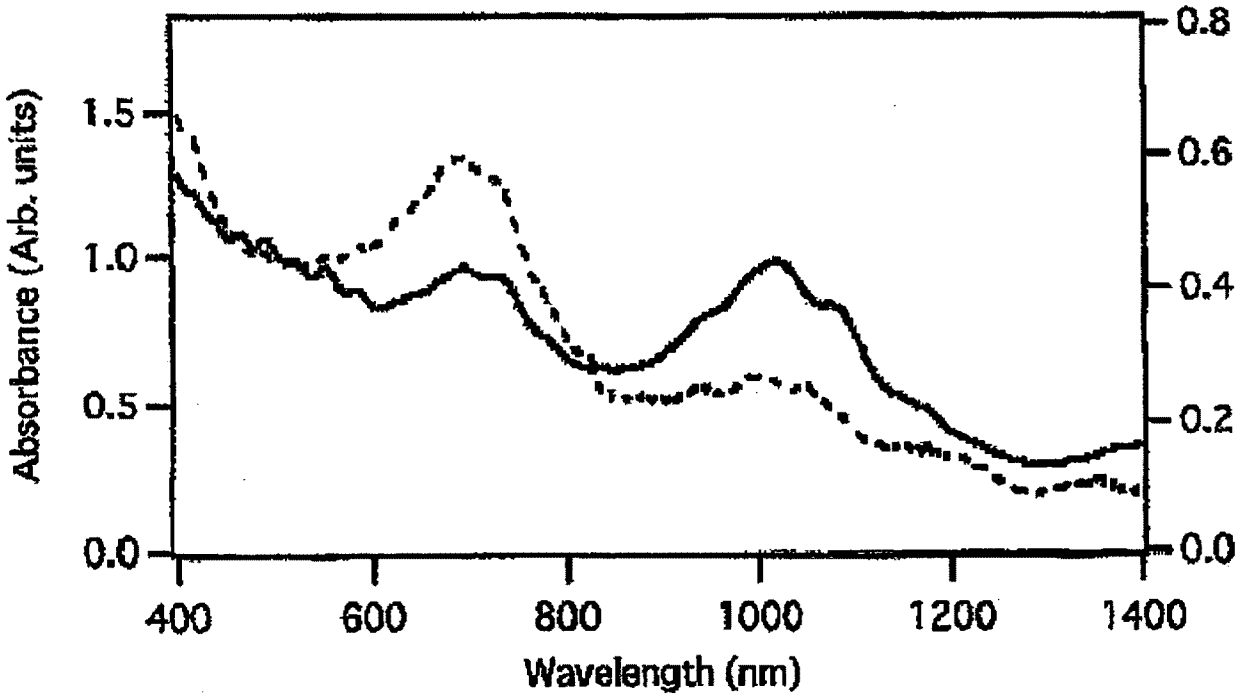
FIG. 10 It shows absorption spectra of single-walled carbon nanotubes of dispersion 1 (dotted line) and single-walled carbon nanotubes of dispersion 2 (solid line) in Example 5.

The single-walled carbon nanotubes in these dispersions 1 and 2 were analyzed through spectrometry. FIG. 10 shows absorption spectra in a wavelength range of from 400 to 1400 nm. For the spectrometry, used was a spectrophotometer (UV-3150, by Shimadzu Corporation). The single-walled carbon nanotubes in the dispersion 1 (dotted line) gave sharp peaks in a range of from 500 to 800 nm, which indicate that the bundled m-SWNTs were unbundled into individual ones owing to the addition of propylamine to the THF solution. As compared with the pattern of the single-walled carbon nanotubes in the dispersion 2 (solid line), the absorption in the first band transition range (600 to 800 nm) of m-SWNTs in the dispersion 1 increased while the absorption in the second band transition range (850 to 1200 nm) of s-SWNTs decreased; and it is known that m-SWNTs were concentrated in the dispersion 1.

The single-walled carbon nanotubes in the dispersion 2 (solid line) were analyzed through absorption spectrometry, in which the absorption in the first band transition range (600 to 800 nm) of m-SWNTs decreased while the absorption in the second band transition range (850 to 1200 nm) of s-SWNTs increased as compared with those of the single-walled carbon nanotubes in the dispersion 1 (dotted line); and it is known that m-SWNTs were not concentrated in the dispersion 2.

Next, using an air brush, the dispersion 1 was uniformly applied onto the surface of a commercially-available PET sheet having a thickness of 100 μm (transmittance: 86.5%) put on a hot plate at about 85° C., and the solvent tetrahydrofuran and the dispersant propylamine were removed through evaporation by the heat of the hot plate. Next, the thin film was washed with methanol to remove the amine residue, thereby giving a single-walled carbon nanotube thin film-coated PET sheet.

The surface resistivity of the single-walled carbon nanotube thin film was measured with a four-probe resistivity meter (Loresta by Mitsubishi Chemical) in air at room temperature, and the surface resistivity thereof was 920Ω/sq.

The visible light transmittance in a wavelength range of from 400 to 800 nm of the single-walled carbon nanotube thin film-coated PET sheet and that of the original PET sheet were measured with a spectrophotometer (UV-3150 by Shimadzu Corporation); and the transmittance of the single-walled carbon nanotube thin film was computed from the difference between the two, and the transmittance thereof was 81.9%.

On the other hand, the dispersion 2 was processed for film formation on the surface of a PET sheet in the same manner as above, thereby forming a single-walled carbon nanotube thin film. The surface resistivity of the single-walled carbon nanotube thin film was measured with a four-probe resistivity meter (Loresta by Mitsubishi Chemical) in air at room temperature, and the surface resistivity thereof was $1.8\times10^3\Omega$/sq.

The visible light transmittance in a wavelength range of from 400 to 800 nm of the single-walled carbon nanotube thin film-coated PET sheet and that of the original PET sheet were measured with a spectrophotometer (UV-3150 by Shimadzu Corporation); and the transmittance of the single-walled carbon nanotube thin film was computed from the difference between the two, and the transmittance thereof was 80.5%.

Reference Example 1

Various amines were formed into 1 M, 3 M and 5 M amine solutions in a solvent of tetrahydrofuran; and under the same condition as in Example 1, single-walled carbon nanotubes (purified HiPco) were dispersed in these solutions and centrifuged.

The resulting dispersions were analyzed through absorptiometry in the same manner as in Example 1, in which the absorbance at a wavelength of 400 nm ($\lambda_{400\ nm}$) t the absorbance at a wavelength of 550 nm ($\lambda_{550\ nm}$), and the absorbance at a wavelength of 800 nm ($\lambda_{800\ nm}$) were read. $\lambda_{400\ nm}$ could be an index indicating the degree of dispersion of SWNTs; $\lambda_{550\ nm}$ could be an index indicating the degree of dispersion of m-SWNTs; and $\lambda_{800\ nm}$ could be an index indicating the degree of dispersion of s-SWNTs. From the data of $\lambda_{550\ nm}$ and $\lambda_{800\ nm}$, the degree of concentration of m-SWNTs could be estimated.

The data of the 1 M amine solution are shown in Table 2; those of the 3 M amine solution are in Table 3; and those of the 5 M amine solution are in Table 4.

TABLE 2

| compounds | λ 400 nm | λ 550 nm | λ 800 nm | density (solution) |
|---|---|---|---|---|
| N,N-dimethyl-n-octylamine | 0.13 | 1.06 | 0.96 | 0.863 |
| tripropylamine | 0.18 | 1.06 | 0.97 | 0.863 |
| triethylamine | 0.367 | 1.05 | 0.95 | 0.867 |
| N,N,N',N'-tetramethylenediamine | 0.411 | 1.05 | 0.96 | 0.871 |
| propylamine | 0.815 | 1.04 | 0.98 | 0.875 |
| 1-methylpropylamine | 0.812 | 1.04 | 0.97 | 0.872 |
| isopropylamine | 0.988 | 1.03 | 0.98 | 0.872 |
| cyclohexylamine | 1.212 | 1.02 | 0.98 | 0.886 |
| ethylenediamine | 1.114 | 1.02 | 0.98 | 0.890 |
| 1,2-diaminocyclohexane | 1.206 | 1.02 | 0.98 | 0.894 |
| 1-methylpiperidine | 0.946 | 1.02 | 0.96 | 0.880 |
| octylamine | 0.635 | 1.00 | 0.98 | 0.871 |
| N,N-dimehtylethylenediamine | 1.243 | 1.00 | 0.97 | 0.880 |
| dipropylamine | 0.395 | 1.00 | 0.97 | 0.868 |
| diethylamine | 0.892 | 1.00 | 0.96 | 0.870 |
| diethylenetriamine | 0.789 | 1.00 | 1.03 | 0.896 |
| pentaethylenehexamine | 0.226 | 0.98 | 1.01 | 0.904 |
| dioctylamine | 0.592 | 0.98 | 0.98 | 0.862 |
| piperidine | 0.908 | 0.97 | 0.96 | 0.886 |
| trioctylamine | 0.32 | 0.96 | 0.97 | 0.854 |
| N-(3aminopropyl)-1,3propanediamine | 0.235 | 0.94 | 1.09 | 0.896 |
| 1,8-diazabicyclo[5,4,0]-7-undecene | 0.021 | 0.00 | 0.00 | 0.908 |
| N,N-dimethylformamide | 0.003 | 0.00 | 0.00 | 0.893 |
| octylamine (before centrifugation) | | 1.00 | 1.00 | |
| tetrahydrofran | | | | 0.899 |

TABLE 3

| compounds | λ 400 nm | λ 550 nm | λ 800 nm | density (solution) |
|---|---|---|---|---|
| 1-methylpropylamine | 0.177 | 1.17 | 0.85 | 0.839 |
| isopropylamine | 0.196 | 1.10 | 0.91 | 0.839 |
| triethylamine | 0.049 | 1.07 | 0.81 | 0.822 |
| diethylamine | 0.270 | 1.07 | 0.91 | 0.832 |
| N,N,N',N'-tetramethylethylenediamine | 0.144 | 1.03 | 0.91 | 0.835 |
| N,N-dimethyl-n-octylamine | 0.023 | 1.03 | 0.86 | 0.812 |
| pentaethylenehexamine | 0.753 | 1.01 | 0.96 | 0.934 |
| propylamine | 0.953 | 1.01 | 0.94 | 0.847 |
| N,N-dimehtylethylenediamine | 1.439 | 1.00 | 1.16 | 0.861 |
| octylamine | 0.537 | 1.00 | 0.95 | 0.835 |
| cyclohexylamine | 1.348 | 0.99 | 0.98 | 0.881 |
| 1,2-diaminocyclohexane | 1.692 | 0.99 | 0.99 | 0.904 |
| 1-methylpiparidine | 0.445 | 0.99 | 0.96 | 0.862 |
| diethylenetriamine | 0.245 | 0.99 | 0.99 | 0.910 |
| piperidine | 1.259 | 0.98 | 0.96 | 0.881 |
| N-(3aminopropyl)-1,3propanediamine | 0.696 | 0.98 | 0.99 | 0.910 |
| dipropylamine | 0.045 | 0.96 | 0.81 | 0.827 |
| ethylenediamine | 0.321 | 0.87 | 0.62 | 0.891 |
| 1,8-diazabicyclo[5,4,0]-7-undecene | 0.093 | 0.40 | 0.32 | 0.947 |
| octylamine (before centrifugation) | | 1.00 | 1.00 | |
| tetrahydrofran | | | | 0.899 |

TABLE 4

| compounds | λ 400 nm | λ 550 nm | λ 800 nm | density (solution) |
|---|---|---|---|---|
| isopropylamine | 0.063 | 1.27 | 0.70 | 0.806 |
| diethylamine | 0.063 | 1.12 | 0.80 | 0.795 |
| propylamine | 0.390 | 1.05 | 0.93 | 0.819 |
| 1-methylpropylamine | 0.324 | 1.05 | 0.9 | 0.805 |
| cyctohexylamine | 1.452 | 1.00 | 0.96 | 0.876 |
| N,N-dimethylethylenediamine | 1.269 | 0.99 | 0.98 | 0.842 |
| octylamine | 0.341 | 0.98 | 0.95 | 0.800 |
| piperidine | 1.240 | 0.98 | 0.95 | 0.875 |
| 1,2-diaminocyclohexane | 2.586 | 0.98 | 0.98 | 0.915 |
| N-(3aminopropyl)-1,3propanediamine | 0.818 | 0.97 | 0.98 | 0.923 |
| 1-methylpiperidine | 0.192 | 0.97 | 0.88 | 0.845 |
| diethylenetriamine | 0.226 | 0.96 | 0.96 | 0.925 |
| triethylamine | 0.012 | 0.87 | 0.51 | 0.777 |
| 1,8-diazabicyclo[5,4,0]-7-undecene | 0.093 | 0.86 | 0.81 | 0.985 |
| dipropylamine | 0.028 | 0.80 | 0.60 | 0.786 |
| ethylenediamine | 0.466 | 0.70 | 0.40 | 0.892 |
| octylamine (before centrifugation) | | 1.00 | 1.00 | |
| tetrahydrofran | | | | 0.899 |

From Tables 2 to 4, it is known that the degree of concentration of m-SWNTs in the dispersions can be readily controlled in a broad range by varying the type and the concentration of the amine used.

Figure 11:
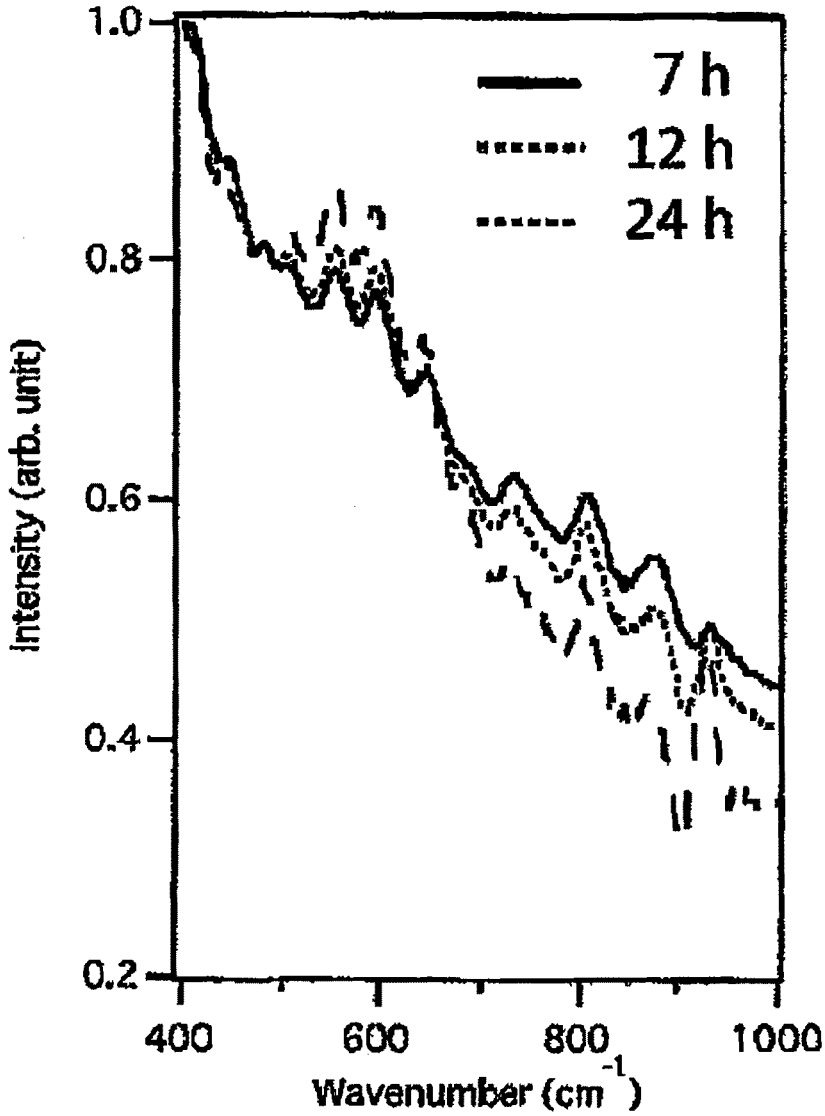
FIG. 11 It shows varying absorption spectra of single-walled carbon nanotube dispersions processed under different centrifugal conditions.

FIG. 11 shows the change in the absorption spectrum of a single-walled carbon nanotube dispersion with octylamine for which the time of centrifugation was varied. When the time for centrifugation was 7 hours, 12 hours, and 24 hours, the content of m-SWNTs in the dispersion varied, as confirmed by the varying absorption spectra.

Figure 12:
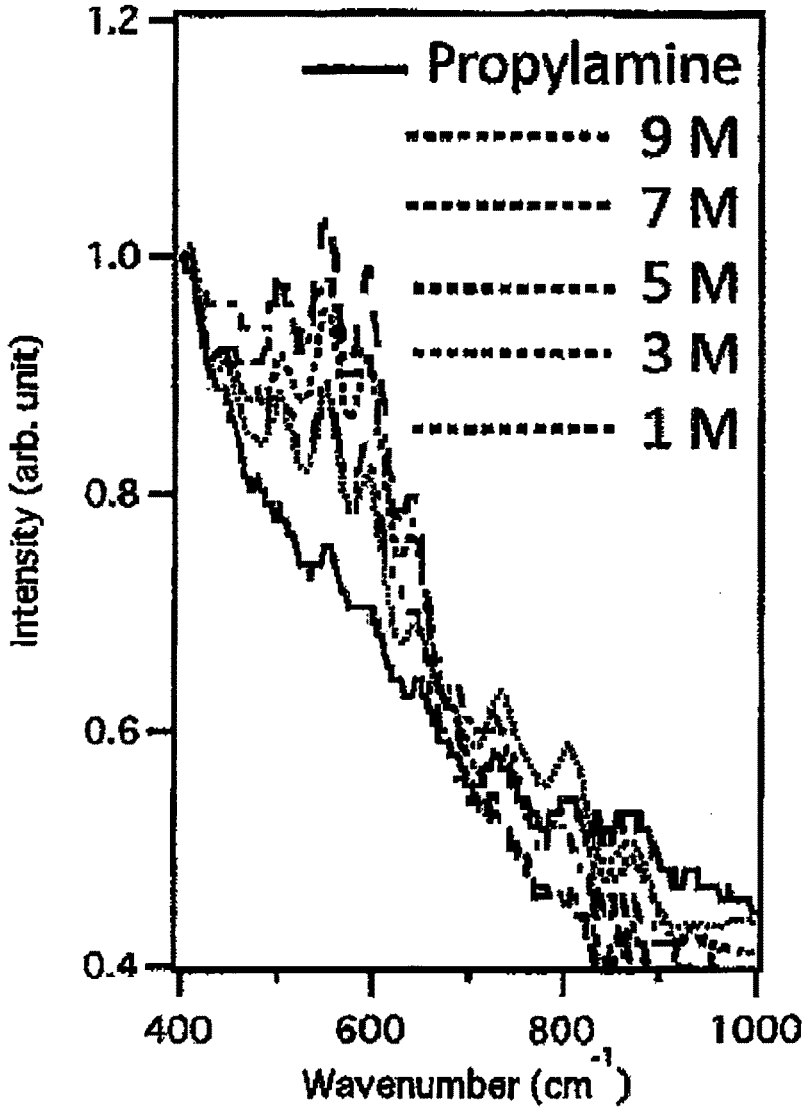
FIG. 12. It shows varying absorption spectra of single-walled carbon nanotube dispersions with varying propylamine concentrations.

FIG. 12 shows the change in the absorption spectrum of a single-walled carbon nanotube dispersion with propylamine in which the propylamine concentration was varied in a range of from 1 M to 9 M. When the concentration was 1 M, 3 M, 5 M, 7 M and 9 M, the content of m-SWNTs in the dispersion varied, as confirmed by the varying absorption spectra.

The invention claimed is:

1. A method for producing a transparent electroconductive thin film comprising:

dispersing single-walled carbon nanotubes of mixed metallic single-walled carbon nanotubes (m-SWNTs) and semiconductor single-walled carbon nanotubes (s-SWNTs) in an amine solution containing an amine having a boiling point of from 20 to 400° C. as a dispersant, wherein the amine solution does not contain a nonvolatile polymer ingredient, centrifuging or filtering the resulting dispersion to concentrate m-SWNTs, thereby giving a dispersion rich in m-SWNTs, and spraying the resulting dispersion rich in m-SWNTs onto a transparent substrate with an airbrush to form a thin film having a thickness in a range of from 10 to 100 nm thereon, then processing the thin film with acid to form a thin film consisting essentially of single-walled carbon nanotubes containing metallic single-walled carbon nanotubes (m-SWNTs) and having a visible light transmittance of from 96 to 97% in a wavelength range of from 400 to 800 nm and a surface resistivity of less than $5\times10^4\Omega/sq$, wherein a plurality of the single-walled carbon nanotubes of the thin film are individually separated and uniformly dispersed in the film as kept in contact with each other while randomly crosslinked therein, and there are no aggregates of single-walled carbon nanotubes.

2. The method for producing a transparent electroconductive thin film as claimed in claim 1, wherein the amine is at least one member selected from the group consisting of primary amines, secondary amines, tertiary amines and aromatic amines.

3. The method for producing a transparent electroconductive thin film as claimed in claim 1, wherein the amine is at least one member selected from the group consisting of isopropylamine, diethylamine, propylamine, 1-methylpropylamine, triethylamine and N,N,N',N'-tetramethylenediamine.

4. The method for producing a transparent electroconductive thin film as claimed in claim 1, wherein the single-walled carbon nanotubes are dispersed in the amine solution while ultrasonically processed.

5. A method for producing a transparent electroconductive thin film comprising:

dispersing single-walled carbon nanotubes of mixed metallic single-walled carbon nanotubes (m-SWNTs) and semiconductor single-walled carbon nanotubes (s-SWNTs) in an amine solution containing an amine having a boiling point of from 20 to 400° C. as a dispersant, wherein the amine solution does not contain a nonvolatile polymer ingredient, centrifuging or filtering the resulting dispersion to concentrate m-SWNTs, thereby giving a dispersion rich in m-SWNTs, and spraying the resulting dispersion rich in m-SWNTs onto a transparent substrate with an airbrush to form a thin film having a thickness in a range of from 10 to 100 nm thereon, then processing the thin film with acid to form a thin film consisting essentially of single-walled carbon nanotubes containing metallic single-walled carbon nanotubes (m-SWNTs) and having a visible light transmittance of from 85 to 96% in a wavelength range of from 400 to 800 nm and a surface resistivity of less than $1\times10^4\Omega/sq$, wherein a plurality of the single-walled carbon nanotubes of the thin film are individually separated and uniformly dispersed in the film as kept in contact with each other while randomly crosslinked therein, and there are no aggregates of single-walled carbon nanotubes.

6. The method for producing a transparent electroconductive thin film as claimed in claim 5, wherein the amine is at least one member selected from the group consisting of primary amines, secondary amines, tertiary amines and aromatic amines.

7. The method for producing a transparent electroconductive thin film as claimed in claim 5, wherein the amine is at least one member selected from the group consisting of isopropylamine, diethylamine, propylamine, 1-methylpropylamine, triethylamine and N,N,N',N'-tetramethylenediamine.

8. The method for producing a transparent electroconductive thin film as claimed in claim 5, wherein the single-walled carbon nanotubes are dispersed in the amine solution while ultrasonically processed.

* * * * *